United States Patent [19]

Winebarger

[11] Patent Number: 5,057,357

[45] Date of Patent: Oct. 15, 1991

[54] SOFT COVERSTOCK WITH IMPROVED DIMENSIONAL STABILITY AND STRENGTH AND METHOD OF MANUFACTURING THE SAME

[75] Inventor: Craig M. Winebarger, Mauldin, S.C.

[73] Assignee: Fiberweb North America, Inc., Greenville, S.C.

[21] Appl. No.: 261,009

[22] Filed: Oct. 21, 1988

[51] Int. Cl.[5] ..... B32B 3/00

[52] U.S. Cl. ..... 428/195; 156/290; 428/171; 428/296; 428/288; 604/366

[58] Field of Search ..... 428/170, 171, 224, 296, 428/288, 903, 195; 156/209, 290, 308.4; 604/366

[56] References Cited

U.S. PATENT DOCUMENTS

| | | | |
|---|---|---|---|
| 3,542,634 | 11/1970 | Such et al. | 161/88 |
| 4,041,203 | 8/1977 | Brock et al. | 428/157 |
| 4,088,726 | 5/1978 | Cumbers | 264/123 |
| 4,306,929 | 12/1981 | Menikheim et al. | 156/290 |
| 4,333,979 | 6/1982 | Sciaraffa et al. | 428/179 |
| 4,493,868 | 1/1985 | Meitner | 428/171 |
| 4,902,366 | 2/1990 | Bader | 156/296 |

*Primary Examiner*—James J. Bell

*Attorney, Agent, or Firm*—Finnegan, Henderson, Farabow, Garrett & Dunner

[57] ABSTRACT

A soft, nonwoven, fibrous coverstock having opposite faces and having a basis weight in a range of from about 5 grams per square yard to about 120 grams per square yard, machine direction tensile strength in a range of from about 100 grams per inch to about 18,000 grams per inch, cross direction tensile strength in a range of from about 100 grams per inch to about 18,000 grams per inch, cross direction neck-in in a range of about 2% to about 20%, and softness in a range of about 1.8 PSU to about 2.2 PSU. The soft coverstock is produced by a method of passing a fibrous web of thermally bondable fibers through a pair of heated calendar nips to engage each opposite face of the web successively with a patterned roller having raised, discontinuous lands and for fusing portions of the web in a pattern of bond areas.

8 Claims, 10 Drawing Sheets

FIG. 4
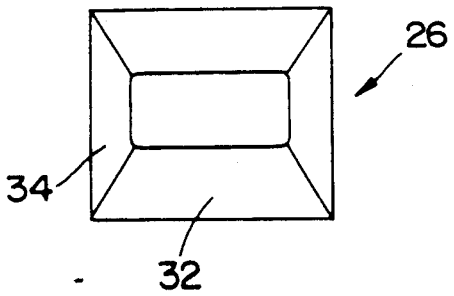
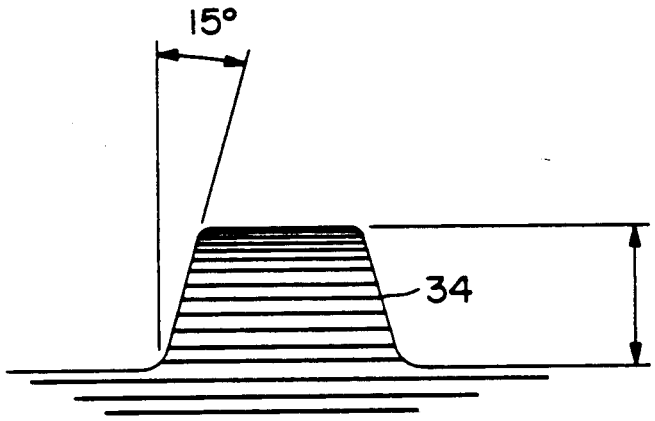
FIG. 5
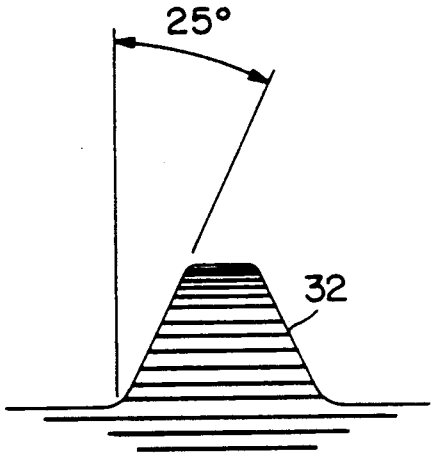
FIG. 6

SOFT COVERSTOCK WITH IMPROVED DIMENSIONAL STABILITY AND STRENGTH AND METHOD OF MANUFACTURING THE SAME

BACKGROUND OF THE INVENTION

1. Field of the Invention

This invention relates to a soft, nonwoven, fibrous coverstock and a method for manufacturing it.

2. Description of the Related Art

Soft coverstocks are used for finished sanitary products such as a diaper top sheet. In such applications, one face or side of the coverstock material is in contact with a human body (for example, the baby side). It is desirable that this face exhibit softness.

Keen competition for such a product generates a need for reducing the cost of the material. A reduction in basis weight of material has a significant impact on reducing the cost of the material. As basis weight decreases, however, other physical properties of the material or fabric are affected. For example, as basis weight decreases the amount of stretch increases at a given tension; such an increase in stretch in the fabric adversely affects the finished product manufacturer's convertibility.

The magnitude and variability of stretch in the fabric creates convertibility problems. These convertibility problems are exhibited both in the machine direction (MD) and in the cross direction (CD). The stretch characteristics of the fabric in the machine direction contribute to an undesirable wrinkling in the finished product, make verification of the lineal yards on the roll difficult, and create discrepancies between reported yards and yardage measurements by the finished product manufacturer. The stretch characteristics of the fabric in the cross direction also contribute to wrinkling in the finished product, affect component alignment, and require rolls to be slit at greater widths (for example, 13⅛ inches for a 12½ inch diaper), thereby increasing the finished product manufacturer's cost.

Increasing the strength of the fabric may reduce stretch, but usually will also adversely affect softness.

SUMMARY OF THE INVENTION

Accordingly, it is an object of the present invention to improve upon known methods of manufacturing nonwoven fibrous web products to produce a soft coverstock with significantly improved dimensional stability and strength without significantly altering softness.

Additional objects and advantages of the present invention may be realized and obtained by means of the instrumentalities and combinations particularly pointed out in the appended claims.

To achieve the objects and in accordance with the purpose of the invention, as embodied and broadly described herein, the method of this invention comprises a method for forming a thermally-bonded fibrous web comprising the steps of passing a web of thermally-bondable fibers through a first calender nip including a relatively smooth roller and a patterned roller, fusing a first portion of the fibers to impart a discontinuous pattern of bond areas which are recessed from one face of the web by applying heat and pressure to the fibrous web in the first nip, passing the fibrous web through a second calender nip including one patterned roller and one relatively smooth roller, the rollers in the second nip being disposed to engage the faces of the web in a manner opposite the first nip, and fusing a second portion of the fibers to form a discontinuous pattern of bond areas which are recessed from the other face of the fibrous web by applying heat and pressure to the fibrous web in the second nip.

As embodied and broadly described herein, the structure of this invention comprises a thermally-bonded nonwoven fabric such as a coverstock having a basis weight in a range of from about 5 grams per square yard to about 120 grams per square yard, a machine direction tensile strength in a range of from about 100 grams per inch to about 18,000 grams per inch, a cross direction tensile strength in a range of from about 100 grams per inch to about 18,000 grams per inch, cross direction neck-in in a range of from about 2% to about 20%, and softness in a range of from about 1.6 PSU to about 2.5 PSU.

BRIEF DESCRIPTION OF THE DRAWINGS

The accompanying drawings, which are incorporated in and constitute a part of the specification, illustrate embodiments of the invention and, together with the description, serve to explain the principles of the invention.

FIG. 4 is a plan view of an individual land of FIG. 3.

FIG. 5 is a front section of the individual land of FIG. 4.

FIG. 6 is a side section of the individual land of FIG. 4.

DETAILED DESCRIPTION OF THE PREFERRED EMBODIMENT

Reference will now be made in detail to the present preferred embodiment of the invention, an example of which is illustrated in the accompanying drawings.

THE METHOD

The method of the invention includes the step of forming a fibrous web of thermally-bondable fibers. The fibers may be polypropylene, polyester, polyethylene, bicomponent, biconstituent, fiber blends containing any of these, or blends containing at least 20% thermoplastic fiber with a nonmelting fiber such as rayon or cotton. The fibers may be about 0.5 to about 10 denier; typical fibers are in a range of about 1 to about 6 denier. In one preferred embodiment, Hercules T-181 fiber is used; this fiber is a 2.0 DPF polypropylene. Other commercially available fibers of varying denier could also be used. In one preferred embodiment, the web is a carded fibrous web, although continuous filaments and microfiber network structures such as from a melt blown process could also be used. The fibrous web may be formed by many known conventional methods.

Figure 1:
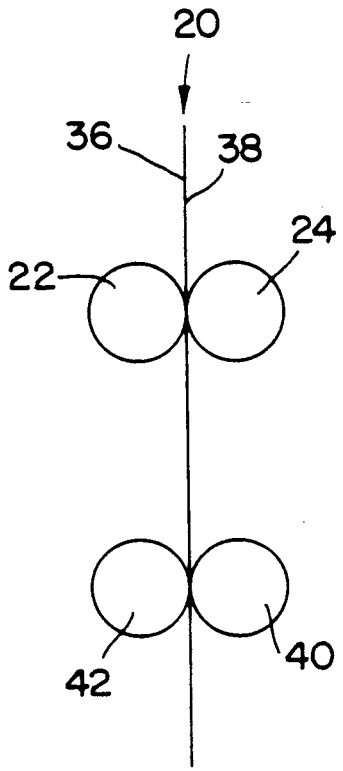
FIG. 1 is a schematic side elevation of an apparatus used for forming the soft coverstock of the invention.
Figure 2:
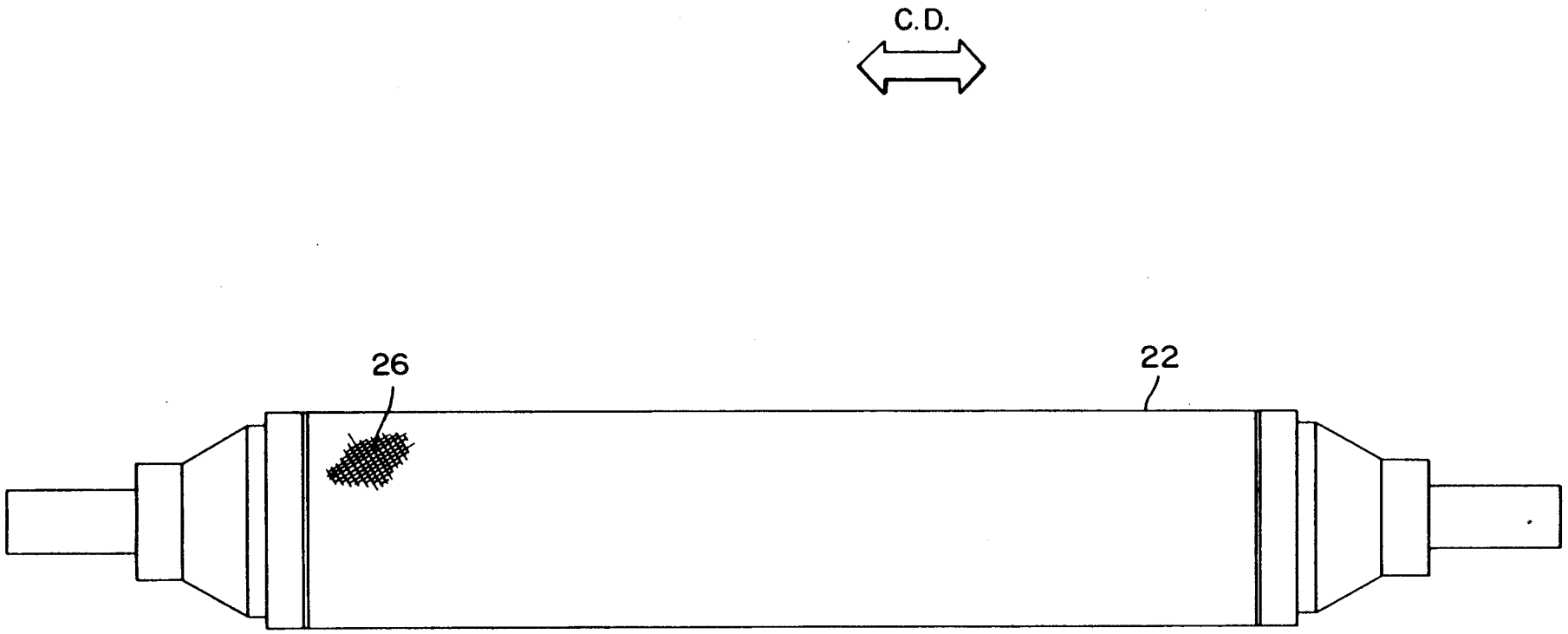
FIG. 2 is a front elevation view of a patterned roller used in the apparatus of FIG. 1.

Further, in accordance with the invention, the method includes passing the fibrous web through a first pair of cooperating rollers defining a first calender nip. As illustrated in FIG. 1, web 20 travels in the machine direction between patterned roller 22 and smooth roller 24 which cooperate to form a first calender nip. Patterned roller 22 is engraved or otherwise marked with a pattern of discontinuous lands 26 as partially illustrated in FIG. 2. As illustrated in FIGS. 3–6, lands 26 have a rectangular perimeter and are oriented in a helical pattern. In one preferred embodiment, illustrated in FIG. 3, the pattern of lands 26 is a helix oriented at 5° to the machine and cross machine directions 28, 30, respectively. Although not tested, this helix may range lower and may range up to about 25° Alternatively, the axis of the patterned roller itself could be offset relative to the axis of the cooperating roller in order to obtain the desired degree of cross axis deviation.

Figure 3:
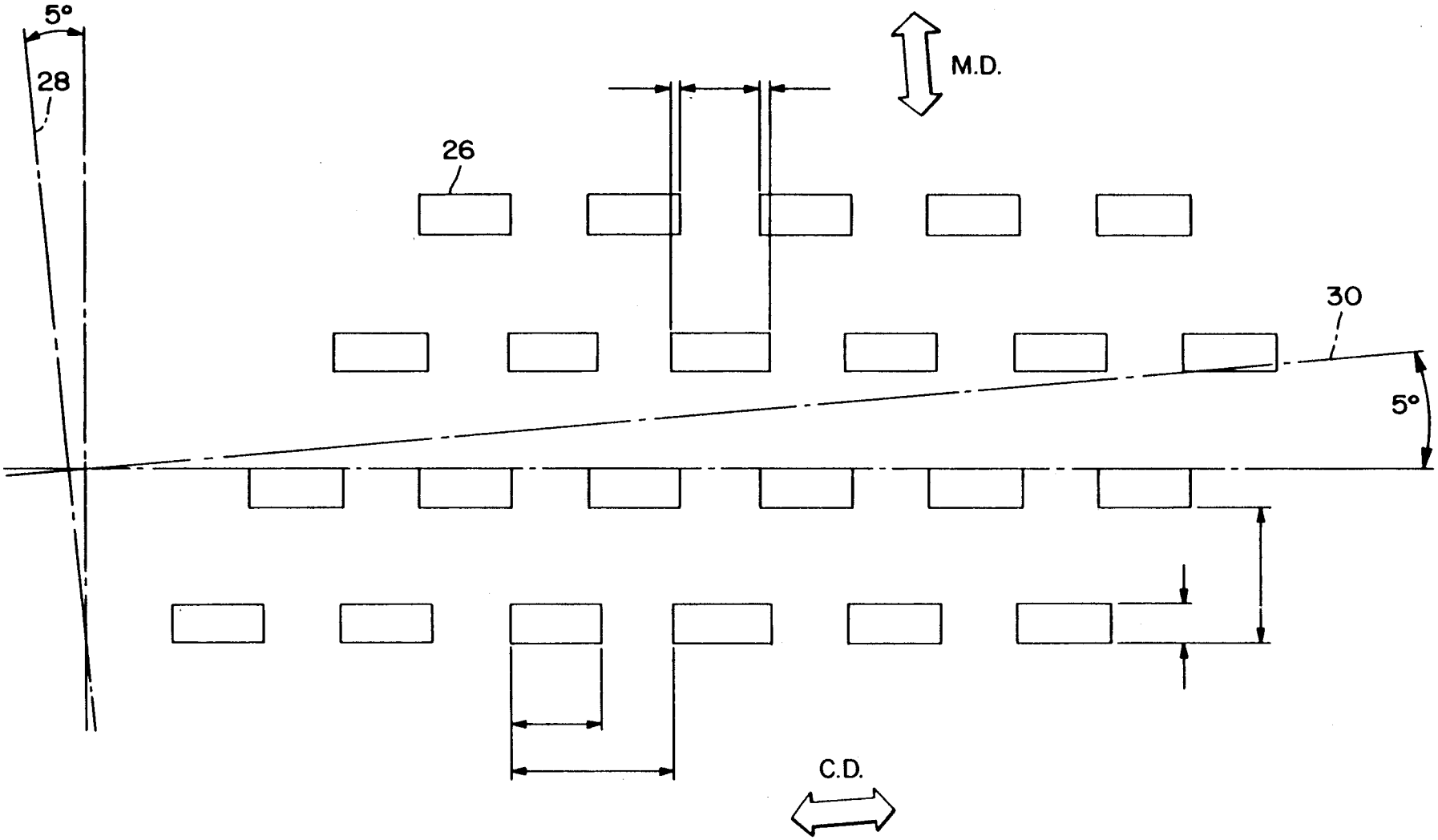
FIG. 3 is a detailed view of raised, discontinuous lands in the patterned roller of FIG. 2.

Preferably, as depicted in FIGS. 3–6, each land 26 is generally a truncated pyramidal shape having a rectangular base with the long sides 32 oriented in the machine direction and the short sides 34 in the cross machine direction. The slope of the short and long sides may be different, such as 15° for the short side and 25° for the long side as depicted in FIGS. 5 and 6. Preferably, as seen in FIG. 3, lands 26 are spaced in the cross machine direction to provide a slight overlap in the machine direction of lands 26 in adjacent rows.

The rollers are steel and in one preferred embodiment the patterned roller is an engraved roller and the smooth roller is an anvil roller which are commercially available. Alternatively, although not actually tested, both rollers in the nip, as disclosed in U.S. Pat. No. 3,542,634, could be engraved.

The method of the invention is not limited to any one pattern. The raised discontinuous lands on the engraved roller correspond to areas of bonding (bond points) on the web. In one preferred embodiment, 17% of the bond area of the roller is covered. Although other bond areas have not actually been tested, these discontinuous lands should cover an area of the roller ranging from about 3% to about 40%, and should preferably be in the range of about 5% to about 20%.

Further in accordance with the invention, the method includes engaging the first face of the fibrous web with a patterned one of the first pair of rollers. Thus, as depicted in FIG. 1, first face 36 of web 20 is engaged by patterned roller 22 in the first nip. Second face 38 contacts smooth roller 24 in the first nip.

Figure 7:
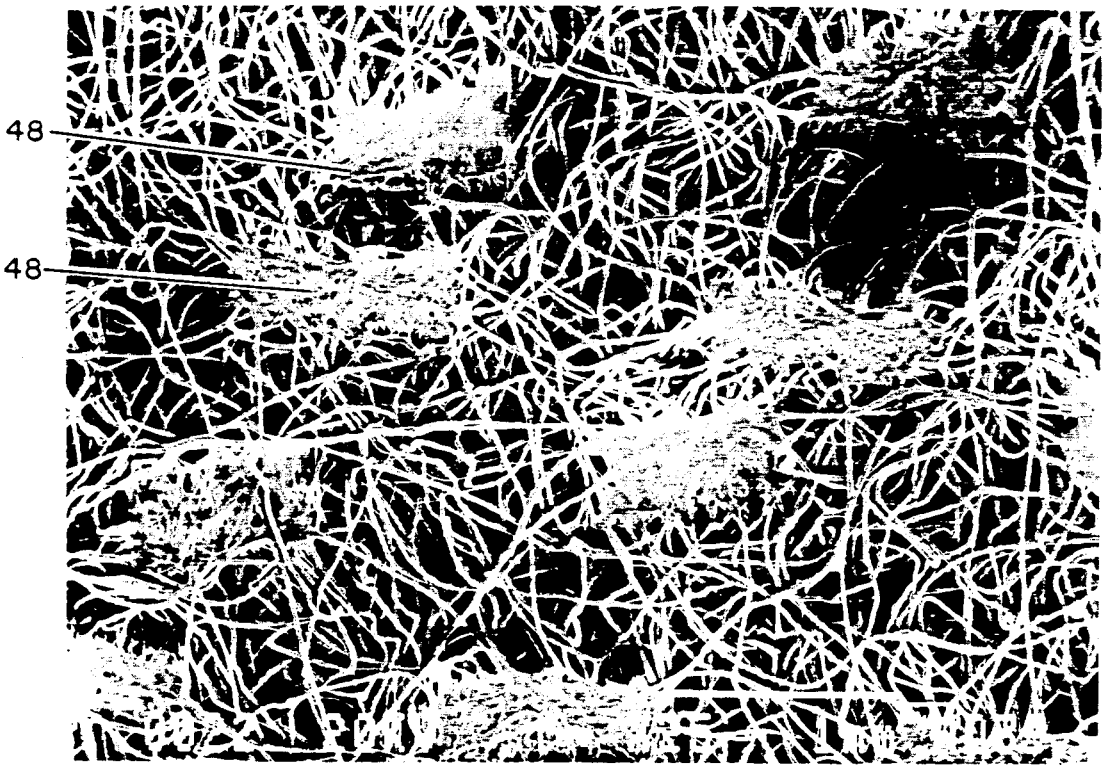
FIG. 7 is a scan electronic microscope (SEM) photograph, at a magnification of 25, of the product of the invention.
Figure 8:
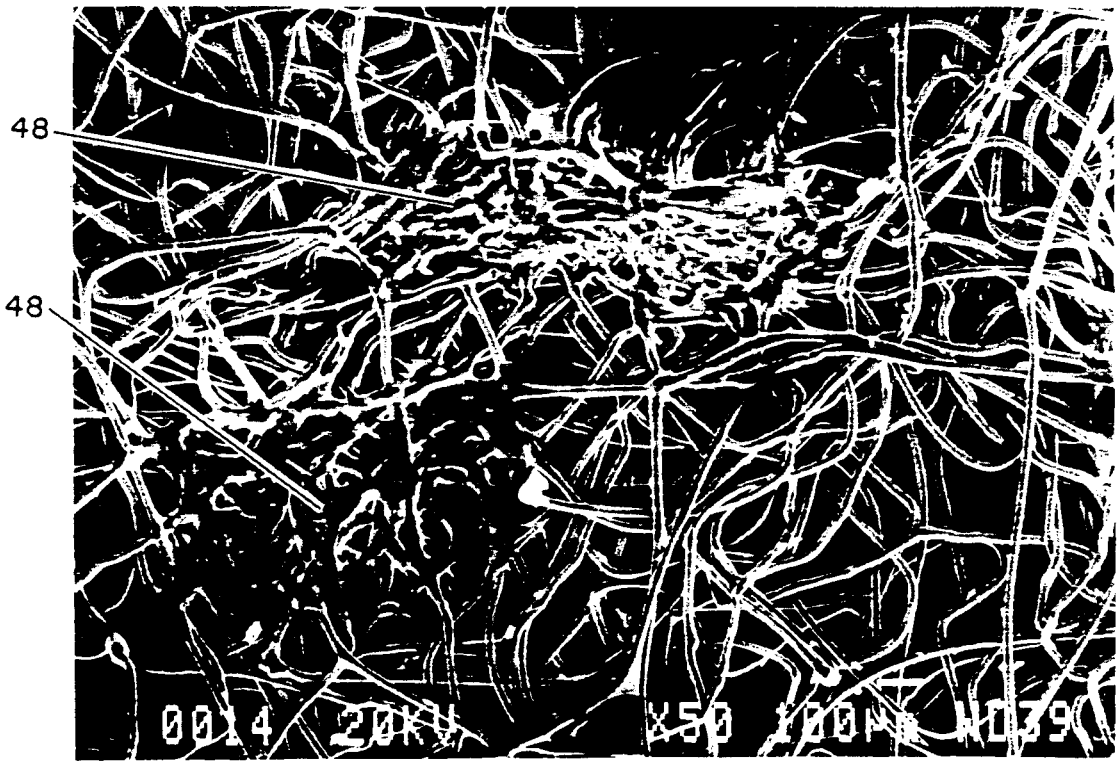
FIG. 8 is a SEM photograph, at a magnification of 50, of the web of the invention.
Figure 11:
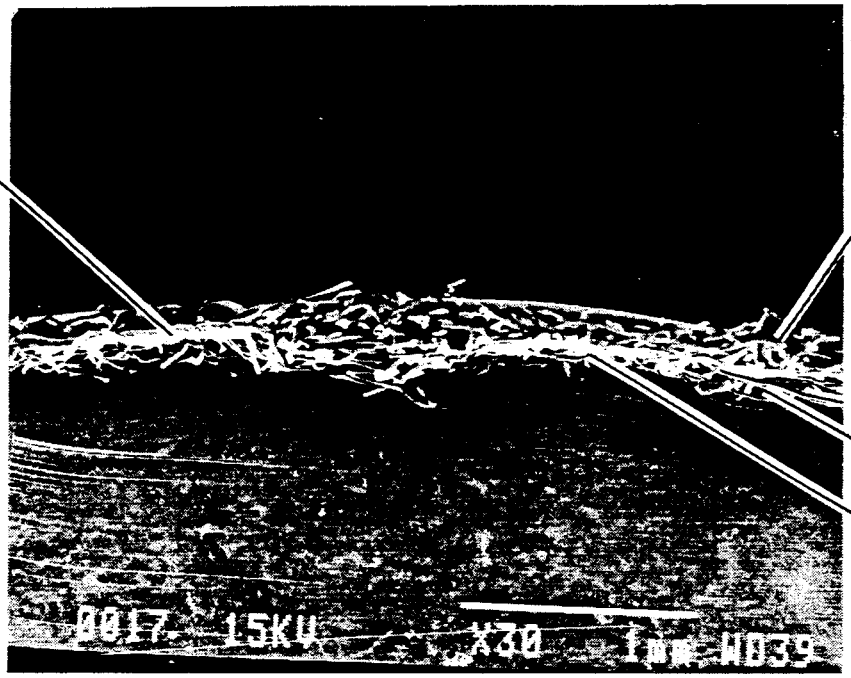
FIG. 11 is a SEM photograph, at a magnification of 30, of a cross section of the products of the invention showing a pair of bond points recessed from the faces of the web.

Further in accordance with the invention, the method includes applying heat and pressure to the web in the first nip for thermally bonding a first portion of the fibers with a pattern of bond points. By applying heat and pressure in a calender nip, portions of the fibers are fused or melted together forming bond points 48. The distance between bond points 48 is less than the average length of the individual fiber, allowing for bonding at more than one point along the length of any given fiber as shown in FIGS. 7–8 and 11. The fibers are typically about 1 to about 3 inches long. In one preferred embodiment, carded staple fibers are about 1.5 inches long.

Bond points 48 contribute to the strength of the web and the nonbonded portions of the web contribute to its softness. In other words, a tradeoff exists between characteristics of strength and characteristics of softness. Higher temperatures in the nip yield greater strength but lower softness.

The temperatures in the nip are established with regard to the line speed of the web and the fiber type. In the first calender nip the surface temperature of patterned roller 22 will be in the range of about 110°–220° C. and the temperature of smooth roller 24 will be in the range of about 110°–220° C. In one preferred embodiment, the temperatures are in a range of about 141°–143° C. and 156°–158° C., respectively, where the web is formed of 2.0 DPF polypropylene fibers. In one preferred embodiment, the pressure in the first nip formed by rollers having a 510 mm diameter is in an operating range of 250–350 pli at line speeds greater than 100 yards per minute for polypropylene fibers having a denier between 1.8 and 2.2.

Further in accordance with the invention, the method includes passing the fibrous web through a second pair of cooperating rollers in a second calender nip, and applying heat and pressure to the fibrous web in the second nip for thermally bonding a second portion of the fibers with a pattern of bond points. In one preferred embodiment, the method includes engaging the opposite second face of the fibrous web with a patterned one of the second pair of rollers. Bond points 48 are illustrated in FIGS. 7–13.

The second calender nip is similar, but need not be identical, to the first calender nip. It may include patterned roller 40 and smooth roller 42, or two patterned rollers. Patterned roller 40 will have a helical pattern of discontinuous lands or, alternatively, the patterned roller could be set at a cross axis offset. The range of bond areas is similar to that of the first nip patterned roller 22 although the actual area on the second roller 40 need not be identical to the area covered by patterned roller 22. When the first nip includes only one patterned roller engaging first face 36 of web 20, a preferred feature of the second nip is that a patterned roller 40 engage second face 38 of web 20. Although not tested, similar beneficial results may be achieved by engaging first face 36 with a patterned roller and second face 38 with a smooth roller in both nips.

In one preferred embodiment, the second nip includes rollers that are essentially identical to the rollers in the first nip, although disposed in reverse orientation to web faces 36, 38.

The temperatures of the rollers in the second nip will be similar to the temperatures in the first nip. Typically, rollers engaging one face of the web will be cooler than the rollers engaging an opposite face. The cooler face is designed to contact a human body in a finished sanitary product (such as the baby side of a diaper top sheet). In one preferred embodiment, roller 42 engaging first face 36 (the baby side) of web 20 is heated to a range of about 143° C. to about 145° C. and roller 40 engaging second face 38 is in a range of about 156°-158° C. Calender pressure in the second nip is about 250-350 pli.

Because of the helical nature of the pattern on the roller, the total bond area will be less than the sum of the bond areas on the individual patterned rollers. For example, in one preferred embodiment, each roller has a bond area of about 17% and the total amount of bond area on the web is about 25.5%. Similarly, although other embodiments have not been actually tested, the range of total bond areas on the web should be about 4.5% to about 60% and preferably about 7.5% to about 30%.

Alternatively, instead of using two sets of calender nips in a continuous process, the method may be practiced in a discontinuous process by passing the web through one pair of cooperating calender rollers twice, adjusting either the patterned roller or the web on the second pass so that the opposite side of the web contacts the patterned roller.

The Product

The method of the invention produces a fibrous web product having a unique balance of physical properties. Specifically, the product of the invention comprises a web of thermally-bondable fibers bonded together in substantially discrete points or locations on both opposite major surfaces or faces of the web. The product has exceptional stability (that is, low MD stretch and CD neck-in) and strength relative to its basis weight and softness. When compared to conventional products, the product of the invention is particularly resistent to neck-in (width reduction in the cross direction as tension is applied in the machine direction).

Figure 9:
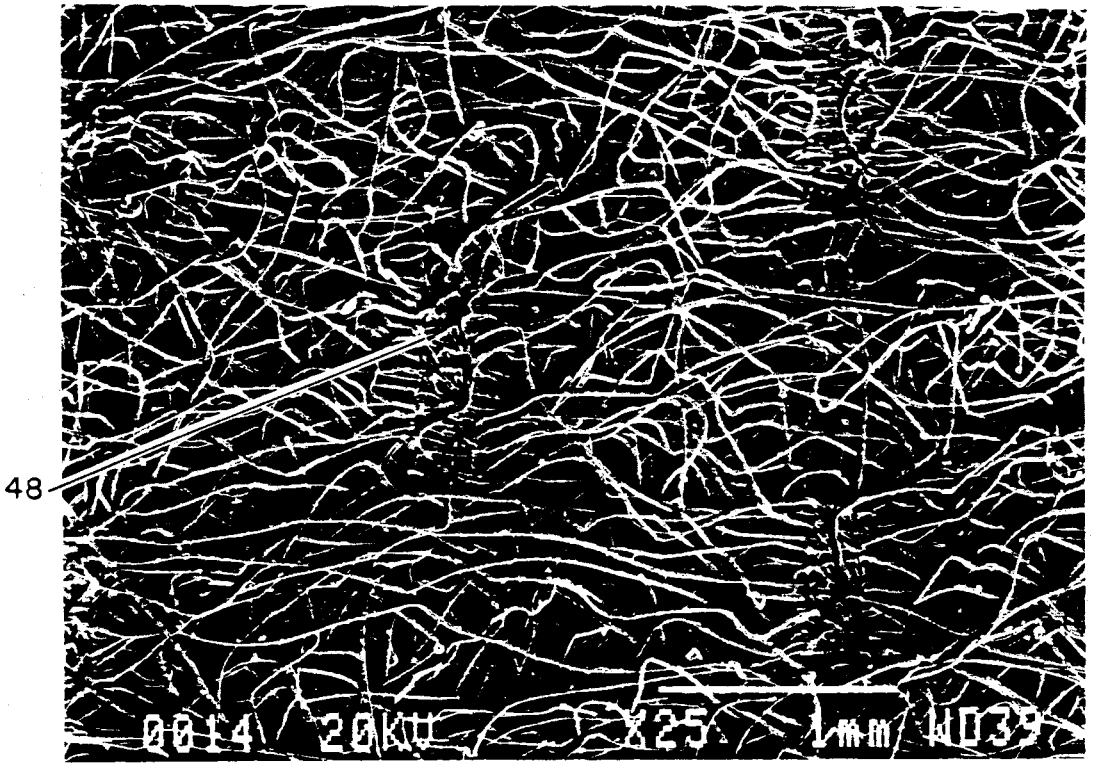
FIG. 9 is a SEM photograph, at a magnification of 25, of a web after passing through a single calendar nip.
Figure 10:
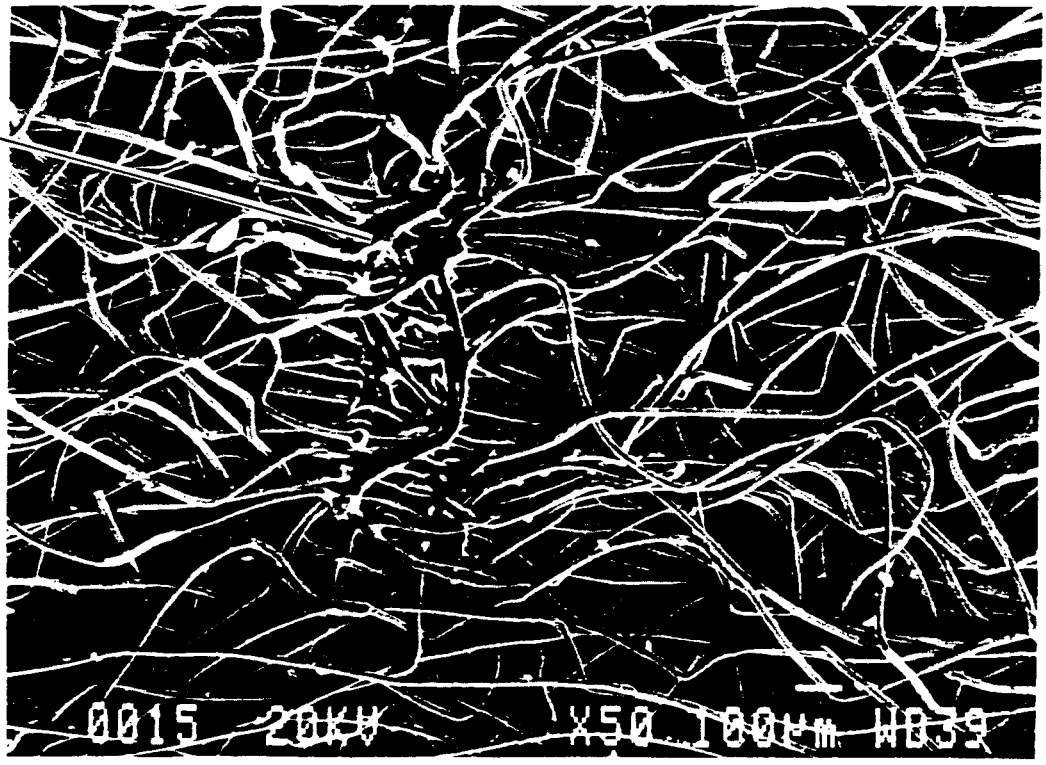
FIG. 10 is a SEM photograph, at a magnification of 50, of a web after passing through a single calender nip.
Figure 12:
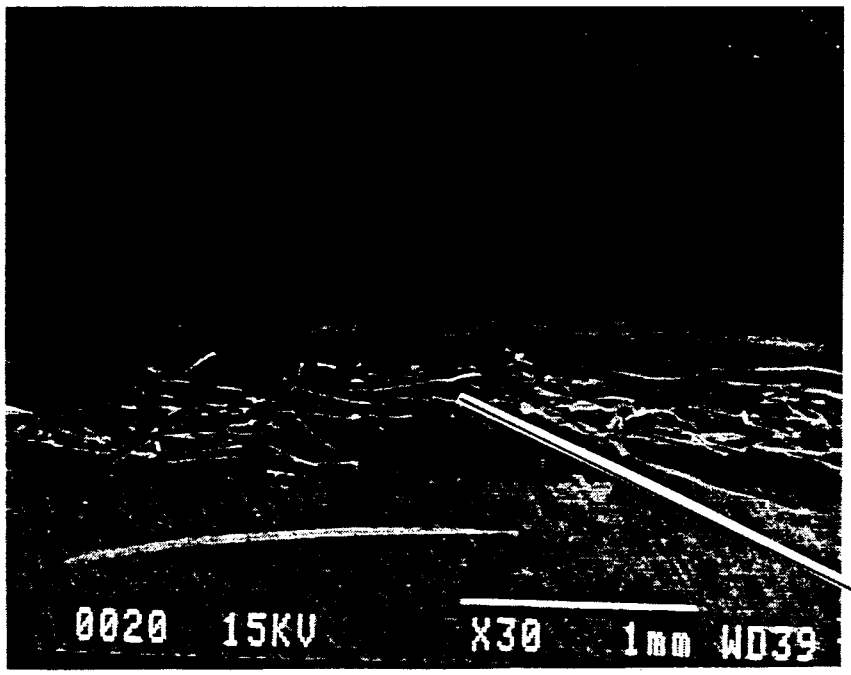
FIG. 12 is a SEM photograph, at a magnification of 30, of a single calender product.
Figure 13:
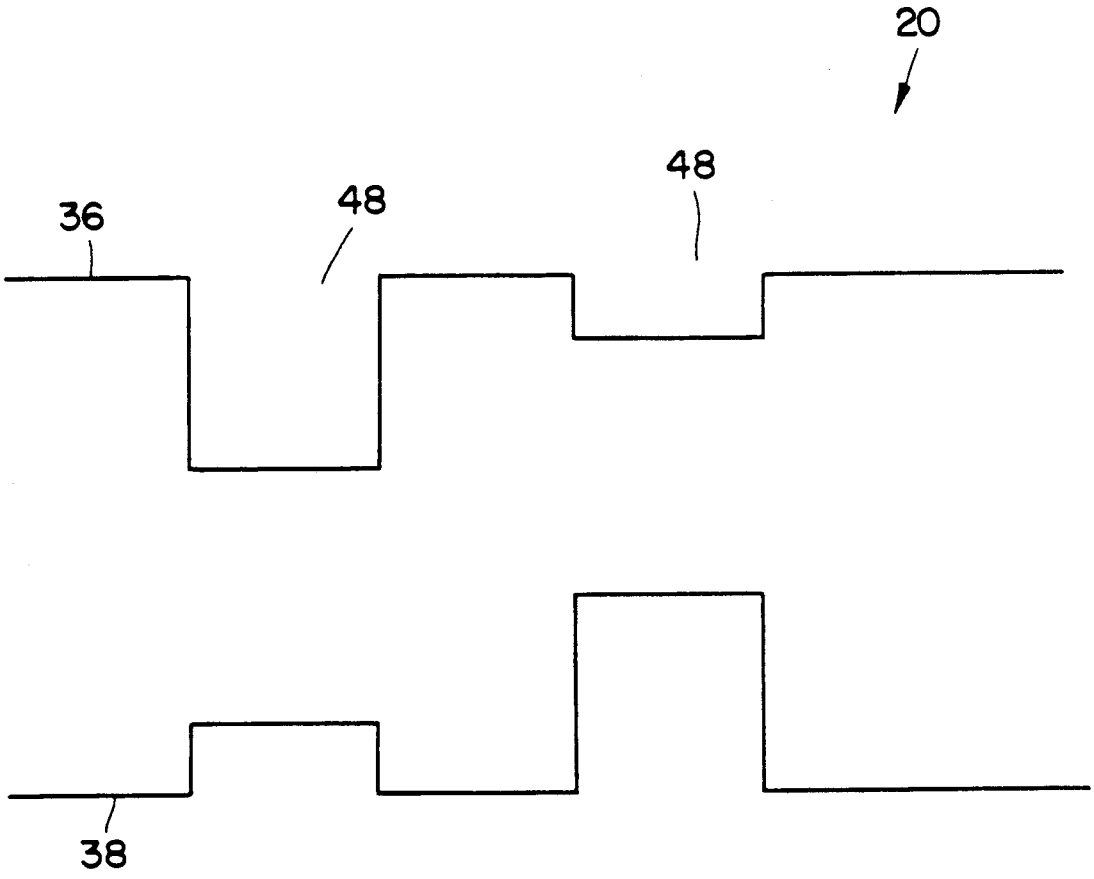
FIG. 13 is an enlarged schematic of a cross section of the product of the invention.

FIGS. 7, 8, 11, and 13 illustrate embodiments of the product of the invention, that is, diaper top sheets after passing through a pair of calender nips. FIGS. 9-10 and 12 illustrate a diaper top sheet after passing through a single calender nip. In FIGS. 7-10, the machine direction is oriented substantially vertically on the page.

Because of the double nip calendering, the discontinuous lands on the engraved rollers form a pattern on the web which visually appears as a honeycomb pattern as shown in FIGS. 7, 8, 11, and 13. In one preferred embodiment, both sides or faces of the web visually appear substantially the same. The double calendering method of the invention also reduces the bulk or caliper of the web from about 11 to 12 mils to about 9 mils. Nevertheless, softness of the web does not decrease proportionately as would have otherwise been expected. Indeed, the 30% increase in tensile strength with only about a 5% decrease in softness achieved is entirely unexpected. In other words, the method of this invention yields a product exhibiting retention of softness with significantly increased tensile strength and dimensional stability.

Figure 14:
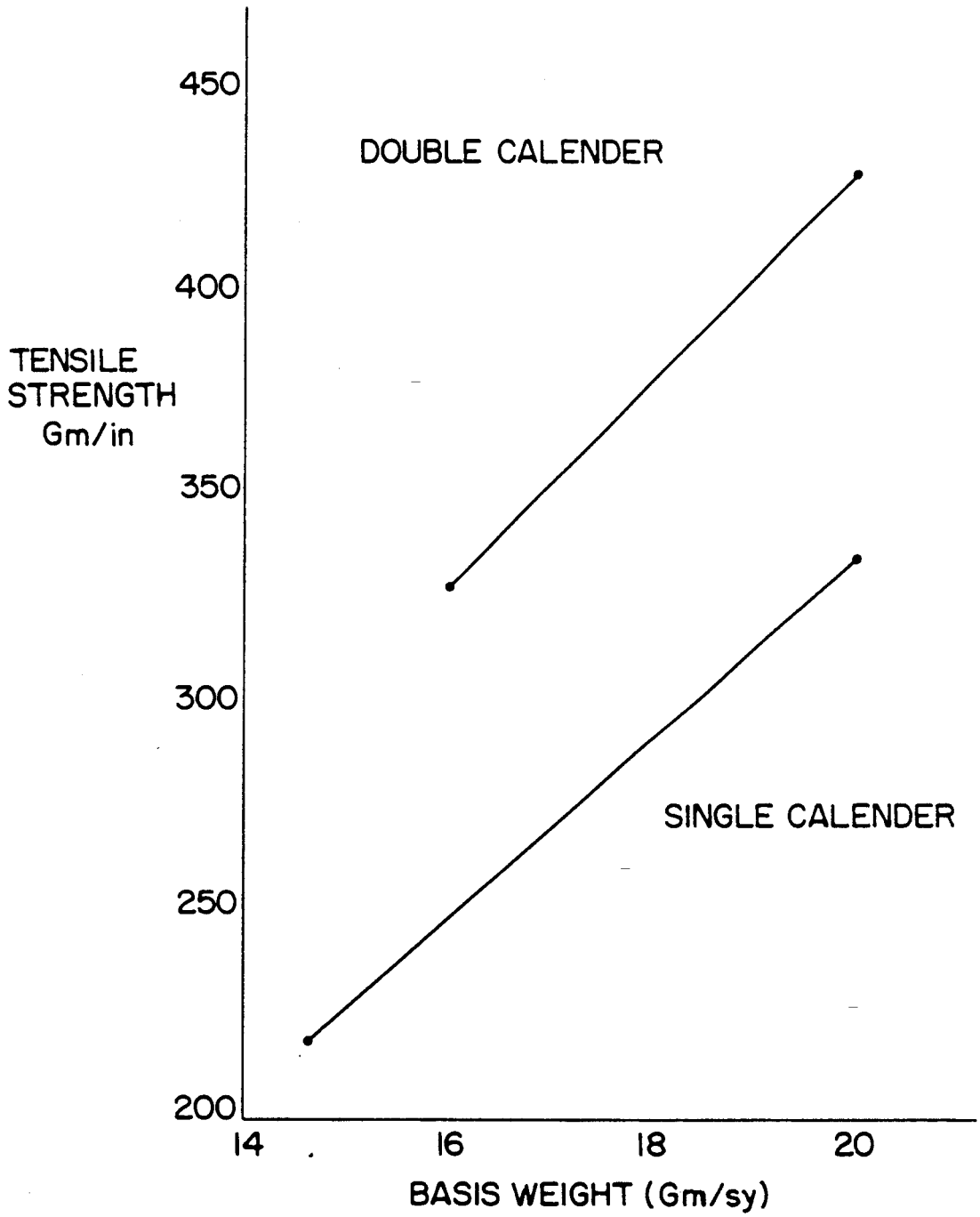
FIG. 14 is a graphical comparison of tensile strength and basis weight for the double calender product of the invention and a single calender product.
Figure 15:
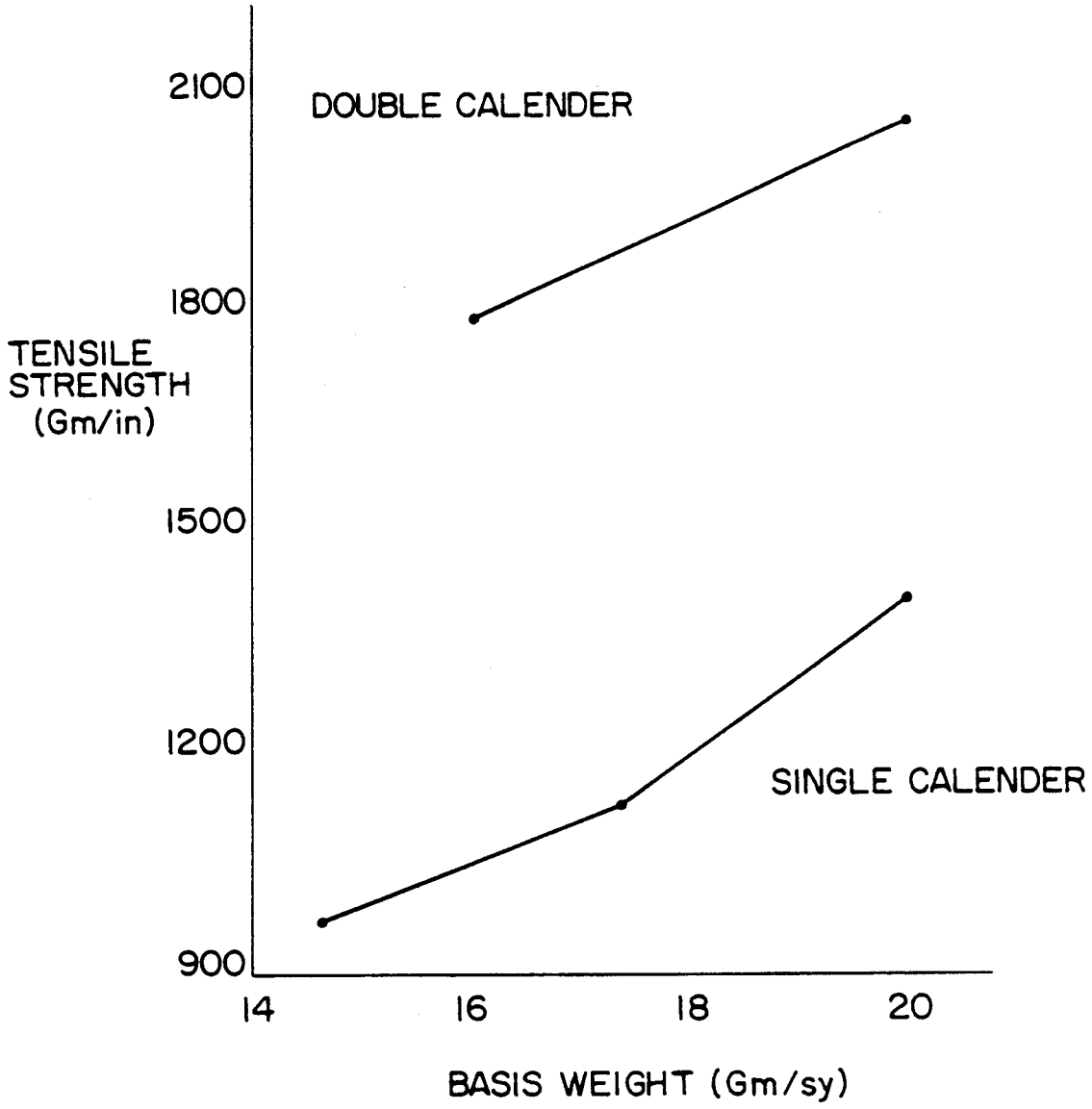
FIG. 15 is a graphical comparison of machine direction tensile strength and basis weight for the double calender product of the invention and a single calender product.

The physical properties of the product illustrated in the accompanying tables I-V and in FIGS. 14-15 are measured by standard industry tests, except for stability. In order to measure stability (stretch in the machine direction and neck-in in the cross direction), the following procedure was employed.

A sample was cut from a web. The sample measured three feet in the machine direction and six inches in the cross direction. The basis weight of the sample was checked by dividing the weight of the sample by 0.1667 yielding a basis weight in grams per square yard. In the center of the sample two lines were drawn; 8 inches long in the machine direction and five inches long in the cross direction; these are the unloaded lengths. The sample was hung in the center of a vertical test stand between top wooden blocks. The sample was fed through the blocks and arranged to be centered and hanging straight and the wooden blocks were then tightened with wing nuts. The bottom of the fabric was then attached to lower wooden blocks which serve as a first load (665.5 grams, corresponding to a tension of 0.734 pounds per linear inch). The MD and CD lines were then measured. A series of known weights were then attached to the lower wooden blocks to increase the load and the MD and CD lines were again measured at each load. In this process five measurements were taken: the lower wooden blocks alone (666.5 grams; 0.734 pli); small weights (196.6 grams; 0.95 pli); large weights (385.0 grams; 1.16 pli); large and small weights (fully loaded) (581.6 grams; 1.37 pli); and no load. The results are expressed as a percentage according to the following formulas. For CD neck-in: (unloaded length−fully loaded length)÷unloaded length. For MD stretch: (fully loaded length−unloaded length-)÷unloaded length.

Tables I-III compare physical properties of embodiments of a conventional product (Product B) with physical properties of embodiments of the product of the invention (Product A). As shown in Table II, even with a reduction in basis weight from 19.9 grams per square yard to 18.2 grams per square yard and a decrease in caliper from 10.6 mils to 8.9 mils, cross direction tensile strength and machine direction tensile strength both increased and softness decreased only marginally. Softness is measured in panel softness units (PSU) by a known Proctor & Gamble test. Table IV compares the product of the invention (A) with a conventional product (B), other of the assignee's diaper top sheet poducts (Products C and D), and a competitor's product. Table V lists typical physical properties of the product of the invention.

The graphs illustrated in FIGS. 14-15 are derived from data in Table I and from historical single calender data and depict, at various basis weights, tensile strength advantages of the double calender product of the invention compared to a single calender product.

Other embodiments of the invention will be apparent to those skilled in the art from consideration of the specification and the practice of the invention disclosed herein. It is intended that the specification and examples be considered as exemplary and explanatory only, with a true scope and spirit of the invention being indicated by the following claims.

TABLE I

COMPARISON OF PHYSICAL PROPERTIES

| | PRODUCT B | | PRODUCT A | |
|---|---|---|---|---|
| BS Wgt (gm/sy) | 19.5 | 19.6 | 18.0 | 16.0 |
| CD Tensile (gm/in) | 340.0 | 430.0 | 370.0 | 330.0 |
| CD Elongation (%) | 98.0 | 78.0 | 76.0 | 75.0 |
| CD TEA (in · gm/in$^2$) | 195.0 | 220.0 | 190.0 | 175.0 |
| MD Tensile (gm/in) | 1400.0 | 2050.0 | 1960.0 | 1840.0 |
| MD Elongation | 35.0 | 54.0 | 43.0 | 44.0 |

TABLE I-continued

| COMPARISON OF PHYSICAL PROPERTIES | PRODUCT B | | PRODUCT A | |
|---|---|---|---|---|
| (%) | | | | |
| MD TEA (in · gm/in$^2$) | 300.0 | 550.0 | 630.0 | 595.0 |
| Elmendorf Tear MD | 81.0 | 58.0 | — | — |
| Elmendorf Tear CD | 136.0 | 92.0 | — | — |
| Caliper (mils) | 12.4 | 8.8 | 8.9 | — |
| Strikethrough (sec) | 2.2 | 2.0 | 2.2 | 2.1 |
| Rewet (gm) | 0.11 | 0.12 | 0.12 | 0.12 |
| Runoff (%) | 0.0 | 0.0 | 0.0 | 0.0 |
| Softness (PSU) | 2.2 | 2.1 | 2.1 | 2.1 |
| Stability | | | | |
| MD Stretch | 6.3% | — | 4.7% | — |
| CD Neck-In | 14.1% | — | 8.7% | — |
| Number of Samples | >100 | >30 | >100 | >10 |

TABLE II

| COMPARISON OF PHYSICAL PROPERTIES | PRODUCT B | | | PRODUCT A | | |
|---|---|---|---|---|---|---|
| | AVG. | STD. DEV. | +3 STD. DEV. | AVG. | STD. DEV. | +3 STD. DEV. |
| Number of Samples | 200 | — | — | 205 | — | — |
| BS Wgt (gm/sy) | 19.9 | 0.9 | 17.2–22.7 | 18.2 | 1.1 | 14.9–21.4 |
| CD Tensile (gm/in) | 330 | 37.8 | 217–443 | 368 | 48.8 | 222–515 |
| CD Elongation (%) | 112.5 | 15.0 | 67.5–157.4 | 76.2 | 8.4 | 51.1–101.3 |
| CD Tea (in-gm/sq. in.) | 215.5 | 43.3 | 85.7–345.4 | 193.3 | 34.9 | 88.5–298.1 |
| MD Tensile (gm/in) | 1564 | 216 | 917–2211 | 1963 | 208.5 | 1338–2589 |
| MD Elongation (%) | 34.6 | 6.8 | 14.2–54.9 | 42.8 | 6.5 | 23.2–62.4 |
| MD Tea (in-gm/sq. in.) | 396.8 | 129.4 | 8.7–785.0 | 628.0 | 168.2 | 123.5–1132.5 |
| Caliper (mils) | 10.6 | 0.7 | 8.6–12.6 | 8.9 | 0.8 | 6.6–11.1 |
| Wetability (sec) | 1.8 | 0.2 | 1.2–2.4 | 1.94 | 0.26 | 1.2–2.7 |
| Softness (PSU) | 2.2 | .05 | 2.06–2.35 | 2.18 | .04 | 2.07–2.3 |

TABLE III

| DOWNSTREAM TENSILE VARIABILITY ANALYSIS | PRODUCT B (x/std Dev.) | PRODUCT A (x/std Dev.) |
|---|---|---|
| BS WEIGHT | 20.4/.97 | 18.9/1.11 |
| CD TENSILE | 342/76.7 | 355/54.4 |
| CD ELONG | 116/20.7 | 77/9.2 |
| CD TEA | 230/78.5 | 196/49 |
| MD TENSILE | 1580/251 | 1958/244 |
| MD ELONG | 31.4/5.7 | 41.2/8.7 |
| MD TEA | 359/121.6 | 464/157 |

TABLE IV

REDUCED STRETCH TRIALS

| | PRODUCT B | PRODUCT C | PRODUCT D | PRODUCT A (DOUBLE CALENDER) | COMPETITOR'S FABRIC* |
|---|---|---|---|---|---|
| FIBER | T-181 | T-181 | T-185 | T-181 | PP ? |
| BS WGT | 19.7 | 18.1 | 18.4 | 18.3 | 20.9 |
| CD TENSILES | 321 | 241.0 | 270.0 | 396.7 | 302 |
| STD DEV | 37.4 | 25.2 | 62.7 | 55.1 | 48.1 |
| CD ELONG | 96.6 | 100.0 | 111.9 | 71.7 | 92.5 |
| CD TEA | 179 | 147.4 | 206.2 | 186.7 | 155 |
| MD TENSILES | 1361 | 1186.7 | 1148.4 | 1795.0 | 2427 |
| STD DEV | 122.2 | 74.6 | 253.0 | 152.2 | 341.6 |
| MD ELONG | 35.7 | 28.8 | 36.9 | 30.9 | 37.8 |
| MD TEA | 322 | 229.3 | 430.8 | 372.7 | 553 |
| CALIPER | 10.9 | 9.9 | 10.0 | 9.4 | 11.7 |
| WETABILITY | 2 | 1.7 | 1.8 | 1.9 | — |
| SOFTNESS* | 2.2 | 2.2 | 2.2 | 1.9 | 2.2 |
| MD STRETCH (%) | 6.3 | 8.6 | 7.5 | 5.3 | — |
| CD NECK-IN (%) | 14.1 | 13.8 | 15.4 | 9.8 | — |
| NUMBER ROLLS | 10 | 7 | 5 | 7 | 10/1 |

*BY P & G TESTS

TABLE V

| TYPICAL PHYSICAL PROPERTIES PRODUCT A | |
|---|---|
| FIBER | 2.0 DPF POLYPROPYLENE |
| BS Wgt. (gm/sy) | 17.0–18.0 |
| CD TENSILE (gm/in) | 350–370 |
| CD ELONGATION (%) | 70–75 |
| CD TEA (in-gm/sq in) | 155–165 |
| MD TENSILE (gm/in) | 1700–2000 |
| MD ELONGATION (%) | 40–50 |
| MD TEA (in-gm/sq in) | 400–500 |
| CALIPER (mils) | 9.7 |
| STRIKETHROUGH (sec) | 2.1 |
| REWET (gm) | .12 |
| RUNOFF (%) | 0.0 |
| WETABILITY (sec) | 2.0 |
| SOFTNESS | 2.0–2.2 |

What is claimed is:

1. A thermally-bonded fibrous web having a basis weight in a range of about 10 to about 40 gm/sy and a caliper in a range of about 6.6 to about 11.1 mils produced by a method comprising the steps of:

forming a fibrous web, having a first face and an opposite second face, of thermally-bondable fibers;

passing said fibrous web through a first pair of cooperating rollers in a first calender nip, at least one of said first pair of rollers having a patterned surface;

applying heat and pressure to said fibrous web in said first nip for thermally bonding a first portion of said fibers with a pattern of bond points;

passing said fibrous web through a second pair of cooperating rollers in a second calender nip, at least one of said second pair of rollers having a patterned surface; and applying heat and pressure to said fibrous web in said second nip for thermally bonding a second portion of said fibers with a pattern of bond points.

2. A thermally bonded fibrous web having a basis weight in a range of about 15 to about 21 gm/sy and a caliper in a range of about 8.9 to about 9.7 mils produced by a method comprising the steps of:

passing a web of thermally-bondable fibers through a first calender nip including a relatively smooth roller and a patterned roller;

fusing a first portion of said fibers to impart a discontinuous pattern of bond areas which are recessed from one face of said web by applying heat and pressure to said fibrous web in said first nip;

passing said fibrous web through a second calender nip including one patterned roller and one relatively smooth roller, the rollers in said second nip being disposed to engage the faces of said web in a manner opposite the first nip; and fusing a second portion of said fibers to form a discontinuous pattern of bond areas which are recessed from the other face of said web by applying heat and pressure to said fibrous web in said second nip.

3. A thermally-bonded fibrous web coverstock having a basis weight in a range of from about 5 gm/sy to about 50 gm/sy, a MD tensile strength in a range of from about 100 gm/in to about 10,000 gm/in, a CD tensile strength in a range of from about 100 gm/in to about 3,000 gm/in, CD neck-in in a range of from about 2% to about 20%, and softness in a range of from about 1.6 PSU to about 2.5 PSU.

4. The coverstock as claimed in claim 3, wherein basis weight is in a range of from about 10 gm/sy to about 40 gm/sy, MD tensile strength is in a range of from about 700 gm/in to about 5,000 gm/in, CD tensile strength is in a range of from about 200 gm/in to about 1,000 gm/in, and CD neck-in is in a range of from about 5% to about 12%.

5. The coverstock as claimed in claim 4, having the form of a diaper top sheet and having a basis weight in a range of from about 15 gm/sy to about 21 gm/sy, MD tensile strength in a range of from about 1,100 gm/in to about 2,500 gm/in, CD tensile strength in a range of from about 250 gm/in to about 700 gm/in, and CD neck-in in a range of from about 5% to about 12%.

6. The coverstock as claimed in claim 5, having a basis weight in a range of about 17 to about 18 gm/sy, MD tensile strength in a range of about 1700–2000 gm/in, CD tensile strength in a range of about 350–370 gm/in, CD neck-in a range of about 8–10%, and softness in a range of about 2.0–2.2 PSU.

7. A thermally-bonded fibrous web having a basis weight in a range of 10 to 40 gm/sy and a caliper in a range of 6.6 to 11.1 mils produced by a method comprising the steps of:

forming a fibrous web, having a first face and an opposite second face, of thermally-bondable fibers;

passing said fibrous web through a first pair of cooperating rollers in a first calender nip, at least one of said first pair of rollers having a patterned surface;

applying heat and pressure to said fibrous web in said first nip for thermally bonding a first portion of said fibers with a pattern of bond points;

passing said fibrous web through a second pair of cooperating rollers in a second calender nip; and applying heat and pressure to said fibrous web in said second nip for thermally bonding a second portion of said fibers with a pattern of bond points.

8. A thermally-bonded fibrous web having a basis weight in a range of 10 to 40 gm/sy and a caliper in a range of 6.6 to 11.1 mils produced by a method comprising the steps of:

forming a fibrous web, having a first face and an opposite second face, of thermally-bondable fibers;

passing said fibrous web through a pair of cooperating rollers defining a calender nip in a first pass, one of said pair of rollers having a patterned surface contacting one of said first and second faces;

applying heat and pressure to said fibrous web in said calender nip for thermally bonding a first portion of said fibers with a pattern of bond points;

passing said fibrous web through said pair of cooperating rollers defining the calendar nip in a second pass, one of said pair of rollers having a patterned surface contacting the other of said first and second faces; and applying heat and pressure to said fibrous web in said calendar nip for thermally bonding a second portion of said fiber with a pattern of bond points.

* * * * *